United States Patent [19]

Schmiesing

[11] 4,306,832

[45] Dec. 22, 1981

[54] FRONT END LOADER WITH IMPROVED REACH CONTROLS

[76] Inventor: Gregory Schmiesing, R.R. #1, New Bremen, Ohio 45869

[21] Appl. No.: 34,393

[22] Filed: Apr. 30, 1979

[51] Int. Cl.[3] ..... E02F 3/74

[52] U.S. Cl. ..... 414/718; 414/692; 414/715; 414/728.

[58] Field of Search ..... 414/690, 692, 697, 714, 414/715, 718, 728

[56] References Cited

U.S. PATENT DOCUMENTS

| | | | |
|---|---|---|---|
| Re. 23,392 | 7/1951 | McDade | 414/692 |
| 2,348,796 | 5/1944 | Ferwerda et al. | 414/690 X |
| 2,767,869 | 10/1956 | Miller | 414/718 |
| 2,990,072 | 6/1961 | Mindrum | 414/715 X |
| 3,129,831 | 4/1964 | Mrozek | 414/692 |
| 3,297,182 | 1/1967 | Barry | 414/728 X |
| 3,543,956 | 12/1970 | Furuno et al. | 414/718 |
| 3,648,871 | 3/1972 | Layton | 414/715 |
| 3,912,095 | 10/1975 | Miller | 414/686 |
| 4,162,873 | 7/1979 | Smith | 414/728 X |

*Primary Examiner*—Leslie J. Paperner
*Attorney, Agent, or Firm*—Jerome P. Bloom

[57] ABSTRACT

The invention provides material handling apparatus in the form of a lift arm assembly integratable with or releasably applicable to farm tractors or like relatively small, lightweight vehicles for front end loading and leveling having extended outreach capabilities. An extensible carriage which mounts stably and for guided reciprocable movement on the lift arms carries a material engaging device so interrelated as to enable an advantageous application of forces therethrough, both to break material free from a mass at ground level and to reorient the placement of material at elevated levels. In certain embodiments the material engaging device is tiltable in response and/or correspondence with movements of the carriage. In a preferred from of embodiment of the invention, a guided movement of the material engaging device and the outreach and tilting thereof is sensitively controlled by separate connectors extending thereto from both the lift arms and the carriage.

20 Claims, 9 Drawing Figures

FIG-1
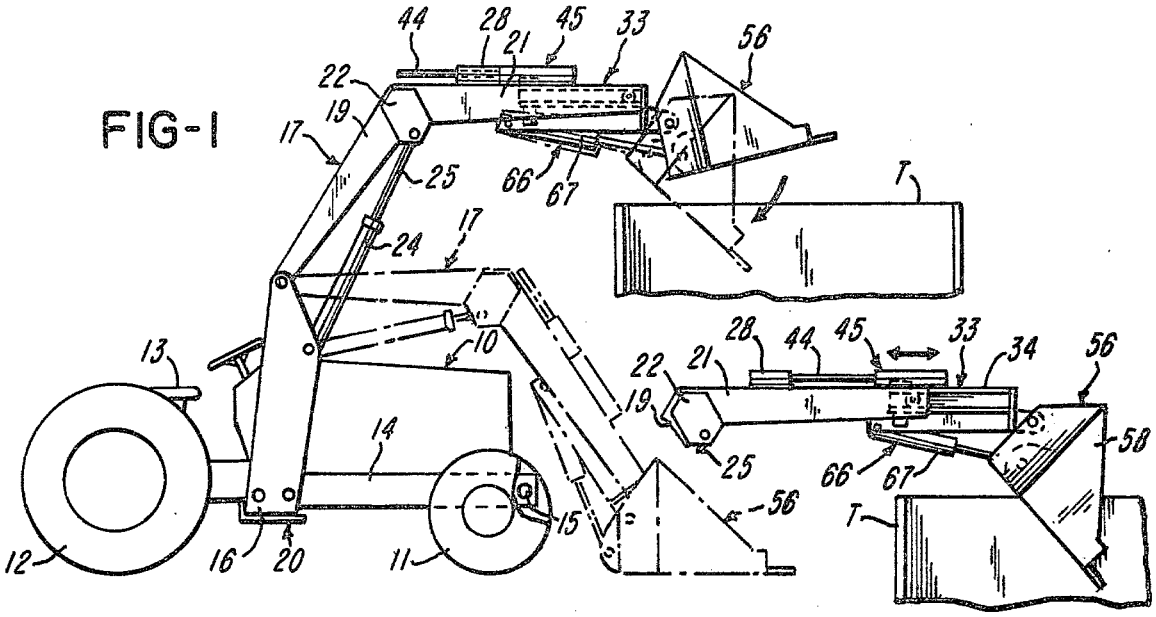
FIG-2
FIG-3
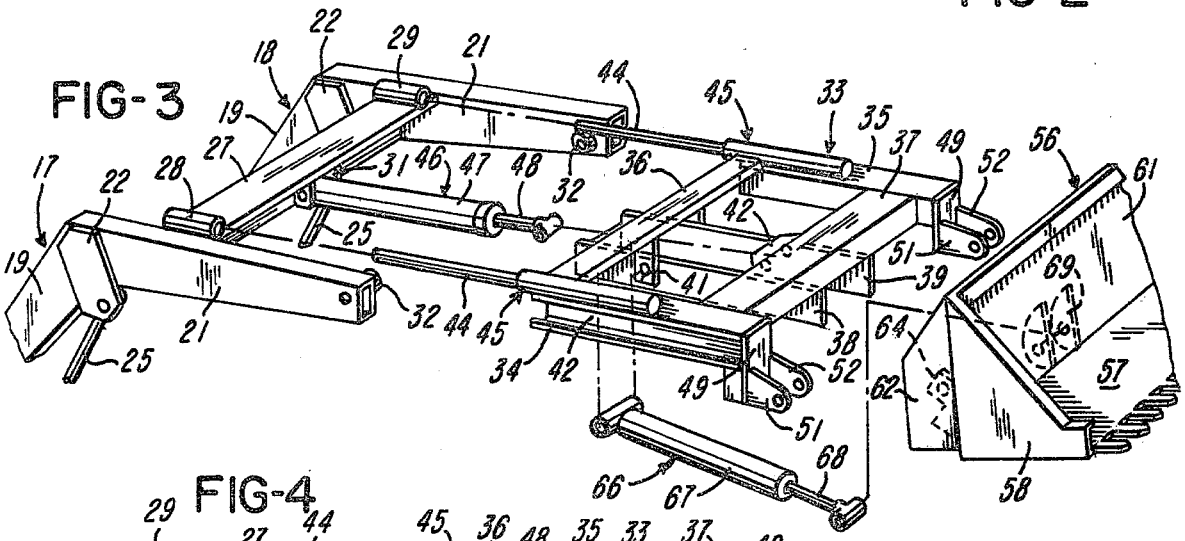
FIG-4
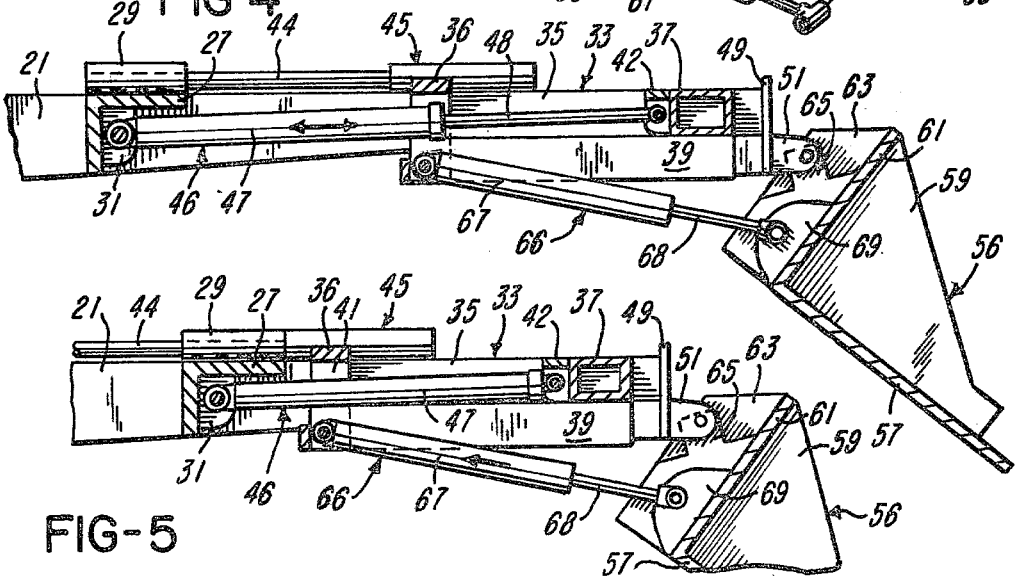
FIG-5

FIG-6
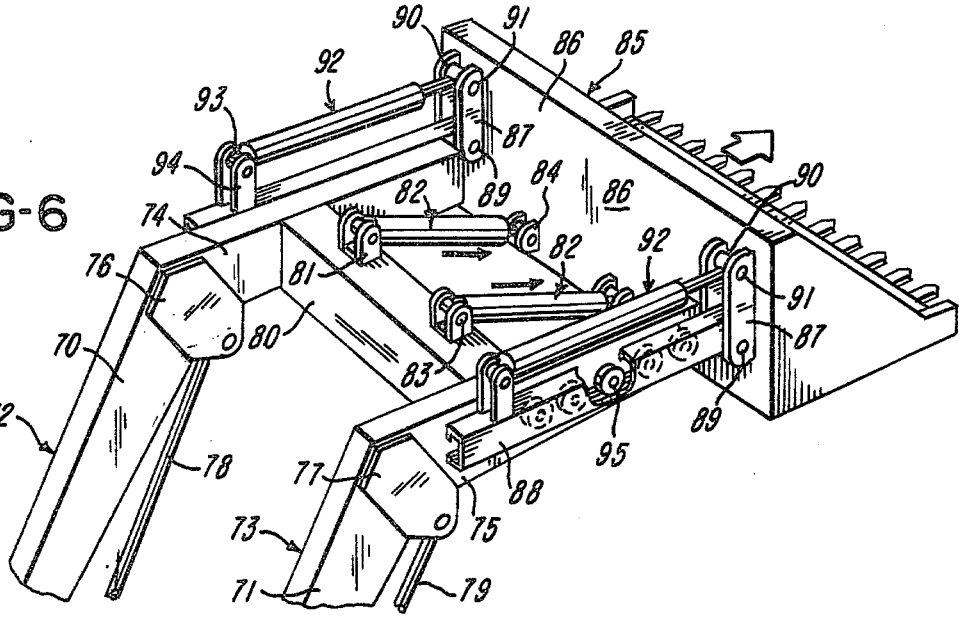
FIG-7
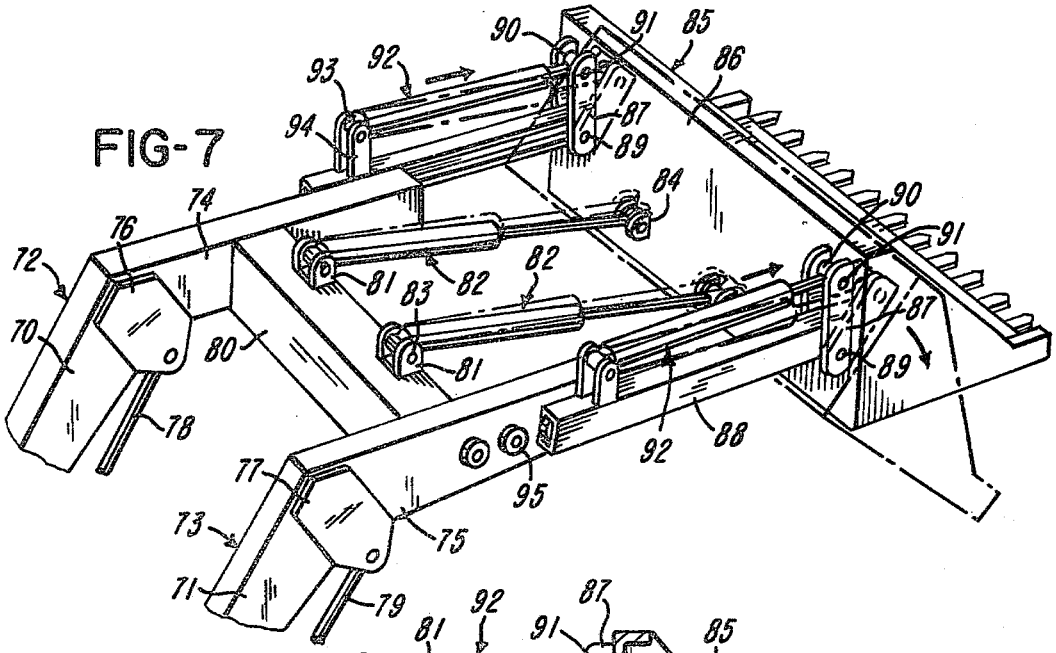
FIG-8
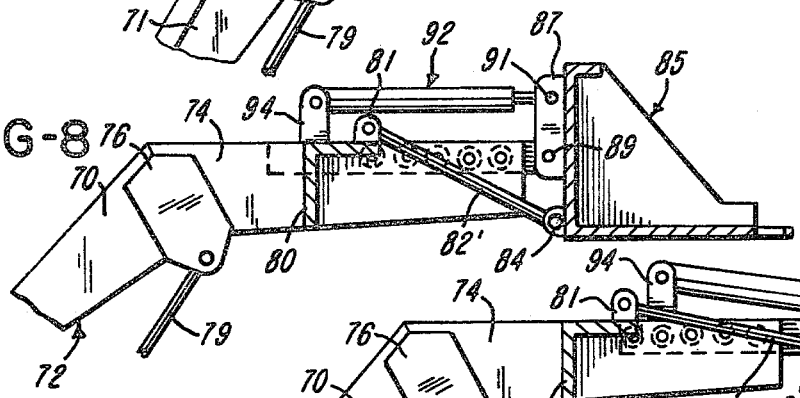
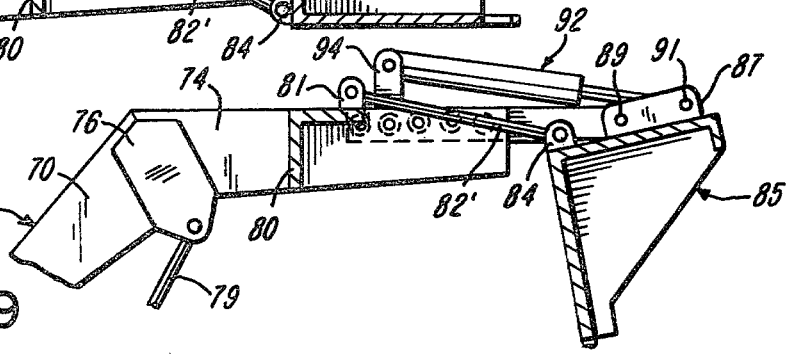
FIG-9

FRONT END LOADER WITH IMPROVED REACH CONTROLS

BACKGROUND OF THE INVENTION

This invention provides improved material handling apparatus particularly adaptable for its releasable application to small, relatively lightweight vehicles. Embodiments have particular advantage for use in connection with farm-type vehicles such as agricultural loaders and will be so described, but only for purpose of illustration and not by way of limitation.

Material handling equipment identifiable as an agricultural loader is exemplified by the Series 22 Agricultural Loader made by Dunham Lehr, Inc. This particular loader comprises conventional lift arms anchored at their inner ends to a vehicle to carry a bucket-type material handling device in pivotal connection with their outer ends. Controls are included for raising and lowering the arms and for tilting movements of the bucket. Apparatus of conventional construction such as this lacks adequate outreach capability and cannot provide for positioning and operation of the bucket so as to achieve adequate load leveling capability.

An improved form of lifting and loading apparatus for use in connection with vehicles such as that of the type evidenced by the Dunham Lehr loader has been disclosed in the Schmiesing Material Handling Equipment subject of application for U.S. patent Ser. No. 875,901, filed Feb. 7, 1978, now abandoned. The apparatus of that application provides improvements in outreach and leveling capabilities of lift arm assemblies and therefore significantly advances the art in this respect. The present invention is a second generation advance of the basic concepts of the aforementioned Schmiesing application. It provides improved apparatus for controlling a material handling device by embodiment thereof in connection with lift arms through the medium of a most stably mounted sliding carriage which is sensitively controlled and has its movements in correspondence with and relative the mounted material handling device so as to achieve a maximum utility thereof.

As will be seen, the present invention answers the need for a lift arm assembly which is simply constructed and most stably controlled to achieve extended outreach of the material handling device which it carries and in a manner to make such apparatus most efficient and satisfactory in use and adaptable to a wide variety of applications. More than this, economy is inherent therein.

Additional prior art of which applicant is aware that in applicant's opinion bears pertinence to the subject matter of this invention is found in the U.S. Pat. Nos. 3,390,794 and 3,967,744. These patents feature ideas for extensible boom constructions but their disclosures do not constitute an arrangement of a stabilized sliding carriage and controls therefor and for a mounted material handling device as provided by the present invention. Nor are the material handling devices thereof under the type of precise and firm control as contemplated by the present invention. Nor do they enable the leveling capabilities inherent in the simple structure achieved utilizing the improvements of the present invention.

SUMMARY OF THE INVENTION

According to one aspect of the present invention, material handling equipment applied to a small vehicle to define an agricultural loader, for example, includes a base which detachably mounts to the vehicle. Angular lift arms which pivotally attach to the base slidably mount and guide thereon a carriage which is supported so as to be capable of maintaining its stability while achieving an extended outreach for the assembly of which it forms a part. Means are provided to selectively and independently raise and lower the lift arms of the assembly and to reciprocate thereon the slidable carriage with simple precision. A bucket or other material handling device mounts on and moves in connection with the carriage and it is itself relatively movable in an oscillatory or tilting sense. The operating components for the carriage and the material handling device are respectively carried by the lift arms of the assembly and the carriage.

The base of the lift arm assembly includes relatively high rising base plates to which the lift arms pivotally attach. The elevated pivoted support of the lift arms at their inner ends and the nature of the arms, in conjunction with an arrangement of the stabilized carriage and the actuating means for the material handling device in connection therewith, allows the device to be brought in quite close to the front of the vehicle to which the lift arm assembly is applied to position the bottom of the material handling device, a bucket, for example, adjacent to and substantially parallel to ground surface. Conditions are established conducive to an advantageous application of breaking forces when applying the material handling device to a load of material which may be frozen in a mass or is otherwise of a consistency as to be difficult to handle and separate and unusually resistant to the engaging and separating of portions thereof.

In a further embodiment of the invention, the material handling device, illustrated as a bucket, includes improved bucket controls for its precise positioning and repositioning in outreach procedures. As here provided, the bucket may be positively held in selected advantageous positions of adjustment in an arrangement which lends it substantial strength and stability in the work to which it is applied. According to bucket controls illustrated, in this embodiment plural connector means are applied to the bucket which are respectively based on the carriage and on the lift arms of the assembly of which it forms a part, with at least one of the connector means being an extensible and retractable actuator. The other connector means may alternatively be an inextensible link or an extensible and retractable actuator. As indicated in a preferred embodiment, the connectors are applied respectively in a sense above and below a horizontal medial plane of the bucket or other material handling device which is pivotally connected in its mount to the slidable carriage.

It is therefore an object of the present invention to provide improvements in material handling apparatus of the type described rendering the same particularly advantageous for releasable application to small vehicles to render such vehicles more efficient and satisfactory in use and with a wider range of application and more practically useful.

Another object is to provide loader apparatus applicable to a farm tractor or like vehicle which gives the loader increased outreach capability while maintaining stability, thereby to adapt a relatively lightweight vehicle to heavy duty work.

A further object is to provide a simple rugged lift arm assembly and means for extending the reach thereof including a carriage slidable on the lift arms which is so formed and mounted as to be inherently stabilized in its movements.

Another object is to provide a vehicle mounted lift arm apparatus enabling a connected material handling device to be positioned in such close coupled relation to the front of the vehicle to which the apparatus is applied as to be most advantageously applicable to break material free from a conglomerate mass thereof, even when the mass is frozen.

Still another object of the invention is to provide an improved arrangement of structure and controls for effecting a precise and stable positioning and repositioning of a material engaging and handling device mounted on lift arms whereby to facilitate use thereof in load leveling to a degree and extent not heretofore possible.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawings wherein are shown some but not all the possible embodiments of the invention, FIG. 1 is a view, partly diagrammatic, showing material handling apparatus in accordance with one form of embodiment of the invention mounted to a farm tractor and in a working position, the lift arms of which mount a bridging reciprocable carriage and supported bucket shown in a fully retracted position;

FIG. 2 is a fragmentary view showing a portion of the apparatus of FIG. 1 to illustrate the slidable carriage and supported bucket device in an extended position;

FIG. 3 is an exploded view, in perspective, showing details of the lift arm apparatus of FIG. 1 and its mounted structure;

FIG. 4 is a fragmentary view in longitudinal section, showing the carriage in an extended position to illustrate a load leveling attitude of the connected material handling device, in this case a bucket;

FIG. 5 is a view like FIG. 4, showing the bucket supporting carriage in a retracted position;

FIG. 6 is a fragmentary view, in perspective, showing a lift arm assembly in accordance with a different embodiment of the invention with the material handling device (bucket) in a retracted position;

FIG. 7 is a view like FIG. 6, illustrating the outreach capabilities provided for the bucket as well as both a leveling and a dumping attitude thereof;

FIG. 8 is a fragmentary view in longitudinal section, showing a modified form of the embodiment shown in FIGS. 6 and 7 with the bucket in a retracted position; and FIG. 9 is a view like FIG. 8, showing the bucket moved to a dumping and load leveling position.

Like parts are indicated by similar characters of reference throughout the several views.

In FIGS. 1 to 5, material handling apparatus in accordance with a first predetermined embodiment of the invention is applied to a compact, truck-like vehicle, shown schematically, including a body 10 conventionally mounted on front wheels 11 and rear wheels 12. Atop the body 10 and positioning intermediate its side margins is a seat 13 from which an operator can control the various machine operations. As exemplified, the disclosed vehicle is a farm tractor and the applied material handling apparatus is a bucket type adapted for commonly encountered farm work including the handling and loading of agricultural products.

The material handling apparatus is mounted to a base support which may include, as shown, side rails 14 (one shown) on opposite sides of the vehicle interconnected at one end, across the front of the vehicle, by a shaft 15. The rails 14 extend rearwardly from the front of the vehicle and have vertically projected plates 16 secured to what may be regarded as their inner ends. The plates 16 in this instance, as shown, are vertically extended from immediately under the chassis of the vehicle to which they are applied to rise upwardly and above the vehicle. It will be understood that the rails 14, shaft 15 and side plates 16 provide a U-shaped base frame portion of the material handling apparatus that may slip fit about the front end portion of the vehicle by driving the vehicle into its open end. As diagrammatically illustrated, brackets 20 fixed to and suspended from the bottom and sides of the vehicle chassis provide pockets the open ends of which face forwardly to receive mating brackets (not shown) in connection with the bottom portions of plates 16. Suitable securing means are then applied to releasably fix the base frame in place with the shaft 15 being disposed immediately of the forward end of the vehicle. It will be obvious, of course, that, if one desires, the base frame described may alternatively be made an integral part ot the vehicle 10.

Lift arms 17 and 18 are respectively pivotally attached to the respective upper extremities of the base plates 16 to either side of the vehicle 10. Each of the arms 17 and 18 is comprised of what may be regarded as an inner portion 19 and an outer portion 21, the arm portions having an angular relation to one another so as to form therebetween an obtuse angle. Although the arms 17 and 18 may be constructed in any convenient manner, the portions 19 and 21 are in this case separate members having abutting ends welded together and in connection with plates 22 across their sides and abutting ends. In any event, by whatever means, the portions 19 and 21 of each arm are in a fixed rigidly connected relation.

Pivotally attached to and centered between the vertical extremities of each base plate 16 is the base end of a conventional hydraulic cylinder 24. The cylinders 24 accordingly position to either side of the vehicle 10 and in an upwardly and forwardly projected relation to the base plates 16. The piston rod 25 of each cylinder 24, which projects from its outermost end, extends to pivotally attach at its outer end to means in connection with the side plates 22 of the lift arm unit the inner end of which pivotally attaches to the same plate 16 and disposes at the same side of the vehicle 10. With this arrangement, each arm 17 and 18 overlies its operating cylinder 24 the projected piston rod of which connects to the arm at its joint.

As will be evident, the cylinders 24 and their accommodated piston rods constitute actuators in that an extension and retraction of the rods 25 effects a raising and lowering of the lift arms. In accordance with known conventional practices the cylinders 24 are or may be connected in a hydraulic circuit including a pump and appropriate controls accessible to an operator on the seat 13. Under operator control, in known manner, hydraulic fluid under pressure is admitted alternatively to opposite ends of the cylinders 24 to effect an extension and retraction of the rods 25. At any selected point in a lifting or lowering movement of the arms 17–18, admission and exhaustion of hydraulic fluid may be interrupted with the result that the arms will be held in a selected, position to which they have been set.

Portions 21 of lift arms 17 and 18 are bridged intermediate their ends and closely adjacent the joint plates 22 by a relatively narrow, transversely disposed, longitudinally extended, rectangular plate 27 the remote extremities of which abut and are welded to the respectively opposed inner side surfaces of the arm portions 21, adjacent their upper edges. Welded to the upper surface of the plate 27, adjacent each of its opposite ends, is a sleeve. These sleeves are respectively identified in the drawings as 28 and 29. The sleeves 28 and 29 are tubular elements arranged parallel to each other and the adjacent arm portions 21. Fixed to depend from the underside of the plate 27, centered between its ends, is a U-shaped bracket 31, the "U" of which is inverted.

As illustrated, the lift arm portion 21 of each arm has a hollow beam-like construction. The arm portions 21 are parallel and their adjacent relatively opposed side faces each mount one anti-friction roller 32 adjacent its outer projected end. The rollers 32 are transversely aligned.

Beyond and outwardly of the plate 27 the adjacent inner sides of the lift arm portions 21 are further bridged by a sliding carriage 33 which gives an extended outreach capability to the lift arm assembly of which it forms a part.

The carriage 33 includes channel-shaped side frame members 34 and 35 which are interconnected by a pair of transversely disposed, longitudinally spaced, elements consisting of a cross bar or plate 36 and a beam 37. The members 34 and 35 each have a generally rectangular U-shaped configuration and are so disposed that their open sides face outwardly of the respectively remote sides of the carriage. The cross element 36 is illustrated to have a plate form and this plate has its respective extremities seating on the upper surfaces of the members 34 and 35, to limited portions thereof which are adjacent their innermost sides, to which portions the ends of the plate 36 are welded. As so disposed the plate 36 is perpendicular to each of the members 34 and 35 and located at what may be considered the rear or inner end of the carriage.

The upper surface of each of the members 34 and 35 mounts an extended end portion of a rod 45 which is welded thereto. These welded end portions of the rods 45 are parallel to each other and directed in lines the direction of which corresponds to that of the members to which they connect. The rods 45 dispose relatively immediately outward of, and perpendicular to and have a welded connection at the adjacent end of the plate 36. Each of the rods 45 are extended in a sense rearwardly of the carriage 33 by a reduced diameter portion 44. As may be seen in FIG. 3 of the drawings, in assembly of the carriage to the arm portions 21, the reduced diameter rod portions 44 telescopically project within and through the sleeves 28 and 29 mounted to the respective extremities of the plate 27.

The carriage 33 is laterally dimensioned to fit between the lift arm portions 21. The laterally projected vertically spaced portions of the carriage frame members 34 and 35 are formed to define in each case a channel 42. The members 34 and 35 are open to what might be considered their rearmost ends to receive therein and track in the channels 42 thereof the anti-friction rollers 32 on the respective arm portions 21 as the carriage is mounted to the lift arms. To apply the carriage 33, due to its lateral dimension it need only be guided between and inwardly of the forward projected ends of the arm portions 21 to receive in the channels 42 of its members 34 and 35 the rollers 32. As the carriage is then moved further inward of the arm portions 21, the carriage is supported on the rollers 32 until the rod portions 44 which project rearwardly of the carrige slide into the tubes 28 and 29 which respectively align therewith in the assembly of the carriage to the lift arms. As this occurs, the carriage is further and most stably supported on and for reciprocating movement relative to the lift arm portions 21 and the sleeves 28 and 29. The rearmost or retracted position of the carriage 33 is achieved as shoulders defined on the rod 45 by the reduction in diameter of their portions 44 abut the forwardmost ends of the sleeves 28 and 29.

Thus, the carriage has a telescoping relation to the lift arm assembly in two senses. First, there is a telescopic interengagement of the sleeves 28 and 29 and the rod portions 44. At the same time, there is a telescopic engagement as between the rollers 32 and the channel members 34 and 35. The arrangement is such to preclude angular misalignment or distorting motions of the carriage relative the lift arms when the carriage must be reciprocated in use thereof.

It should be noted that the outermost positioned ends of the members 34 and 35 are each capped by a plate 49 which is sized and positioned to both project laterally and outwardly from the member to which it connects and to depend downwardly therefrom. The plates 49 are in this case welded to the members 34 and 35 respectively and their laterally extended portions to either side of the carriage serve to provide abutment surfaces since in the retraction of the carriage within and between the arm portions 21 they will abut the outermost projected extremities of the arm portions 21 and thereby assist in determining the rearmost retracted position of the carriage. The forwardmost or outer face of each plate 49, at its dependent extremity, mounts a pair of bracket arms 51 and 52 the projected extremities of which have transversely aligned apertures, the purpose of which will be further described.

Centered between the ends of the plate 36 and fixed to depend from its underside in adjacent parallel relation are plate-like brackets 41. Mounted in connection with the face of the beam 37 most adjacent the plate 36 to align with the brackets 41 is a bracket means 42. The bracket devices 41 and 42 have fixed thereto and assist in the support and positioning immediately below the plate 36 and the beam 37 of a pair of parallel, transversely spaced, longitudinally extended, generally rectangular plates 38 and 39. Viewing FIG. 3 of the drawings, it may be seen that the plates 38 and 39 have their side edges defining their vertical extremities. The bracket means 42 further provide for the reception therein of the adapter on a projected piston rod 48 of a hydraulic cylinder 46 which provides in connection with the rod a transversely disposed tubular sleeve which upon positioning thereof in the bracket means 42, a pivot pin is thrust therethrough by means of which it is pivotally connected to the bracket and to the beam 37. The base end of the housing 47 of the hydraulic cylinder 46 is similarly disposed within the dependent legs of the U-shaped bracket 31 and similarly and pivotally connected thereto, in a manner believed clearly obvious. As may be seen, the cylinder unit 46 serves as an actuator for a reciprocating sliding movement of the carriage 33 between and relative to the portions 21 of the lift arms 17 and 18. Again, the extension and retraction of the piston rod 48 is achieved in a conventional manner a detailed description of which appears unnecessary since the same and the elements involved therein are well known to those versed in this art.

In the embodiment illustrated in FIGS. 1 through 5, there is assembled to the carriage 33 a material handling device 56 of the bucket type. This bucket comprises a back wall 61 and forwardly and perpendicularly projected side walls 58 and 59 the composite of which are bridged at their lower edges by a bottom or working plate 57 formed in a generally planar configuration and to include outwardly projected and laterally spaced teeth. Fixed to project perpendicular to and rearwardly from the outer or rearmost surface of the back wall 61 of the bucket are a pair of wing-like guard plates 62 and 63. Fixed to project similarly from the back wall 61 of the bucket, respectively adjacent and spaced inwardly from the wing-like elements 62 and 63 are further plate-like elements formed to provide at their rearmost edges tongue-like plate portions 64 and 65. The tongue-like portions 64 and 65 are respectively positioned between the bracket arms 51, 52 projected forwardly from the dependent extremities of the plates 49 which are fixed to bridge the forwardmost ends of the carriage members 34 and 35. Pivot pins are applied through aligned apertures in the bracket arms 51, 52 and the tongue element therebetween and fixedly positioned to provide a pivotal support for the bucket 56. In this manner the bucket is connected for movement with and relative to the carriage 33.

Relative tilting movements of the bucket device 56 are enabled by the pivotal connection, to and between the rearmost ends of the plates 38 and 39, of the base end portion of the housing 67 of a conventional hydraulic cylinder unit 66, the projected piston rod 68 of which positions between and is pivotally connected to plates 69 welded integral with and projected rearwardly of the rear wall 61 of the bucket 56. The plates 69 are to the lower end of the wall 61 and centered between its sides. The point of attachment of the rod 68 to the plates 69 is thus below the brackets 51, 52. Accordingly, the cylinder unit 66 may be caused to function with suitable controls, such as previously described, whereby to produce a pivoting of the bucket device and with reference to the brackets 51, 52 and the carriage 33.

From the foregoing description, utility of the lift arm assembly as just described and provided is largely self-evident.

It should be observed that by having the vertical extension of the plates 16 to elevate the points of pivotal connection thereto of the innermost ends of the related lift arms, the generally horizontal disposition of the lift arm portions 21 is enabled and facilitated, for use in the operation and manipulation of the bucket, providing it with improved load levelling capabilities the range of which is extended by the out-reach enabled by reason of the structure and mount of the carriage 33. Furthermore, this arrangement as well as the use of lift arms having the angularly related portions as shown and described facilitates, with the carriage 33 retracted, and a modest sizing of the assembly, that upon lowering of the lift arms the bucket can be caused to be moved to ground surface and immediately of the forwardmost end of the vehicle 10, with the bottom and operating plate 57 of the bucket generally parallel to and adjacent ground surface. The arrangement thus provided insures a maximum application of force through the bucket and the projected operating edge of its bottom plate portion 57 to achieve a substantial breaking or separating force on any mass to which the bucket is applied, to break free and move portions thereof from a ground level to an elevated position and outwardly of the vehicle for deposit in any selected place within the range of the vehicle and the applied lift arm assembly.

As will be self evident, in any position in which the left arms 17 and 18 are placed, there is the option to energize any one or combination of the hydraulic cylinder units 24, 46 and 66. The means and methods for accomplishing this are of course not detailed, as previously mentioned, since the common practice and application of such controls may be variously contrived and utilized in manner well known by those involved in this particular type of art.

Not only does the carriage 33 have a capability of a ready and stably mounted movement out from the lift arm portions 21 so as to substantially extend the effective length thereof but the position of the carriage is such that there is a degree of containment between the arms achieving stability not only of the carriage but of the arms themselves. The arrangement is such to give to the assembly maximum strength enabling a substantial load accommodating capability for the assembly without distortion in any respect.

The compound bearing relation of portions of the carriage assembly 33, on the one hand to the sleeves 28 and 29 which are supported by the plates 27 and the arm portions 21 which are braced by this plate and on the other hand to the bearings 32 which may be single bearings in connection with the outer ends of the arm portions 21 is also unique and structurally advantageous. An optimally balanced and free reciprocating movement of the carriage is insured. Note also the ease of assembly and disassembly of the carriage assembly from the lift arm structure, in the process of which the single rollers 32 in each case serve as guides for the continuing support of the portions 44 of the rods 45 in connection with the frame of the carriage assembly 33. The whole construction and arrangement of parts is such to not only minimize fabrication but to minimize maintenance requirements and facilitate assembly and disassembly of the lift apparatus with reference to its parts and with reference to the vehicle to which the same is applied.

There may be extended usage of the bucket 57 for leveling, spreading and/or raking a load or mound of material, as needs require. As shown in the drawings, the arm units 17 and 18 may be lifted for the horizontal orientation of the arm portions 21, under the influence of the hydraulic cylinder units 24, and the vehicle manipulated into place, to place the bucket over a receptacle on the bed of a large truck, for example, whereupon with suitable manipulation and retraction of the piston rod 68, one can dump the bucket. Assuming that the loading of the truck has proceeded to a point where the material deposited in the receptacle is in a mound and the bottom of the receptacle is not properly filled, one need only actuate the hydraulic cylinder unit 46 to project and retract the rod 48 thereof, whereby to move the carriage assembly 33 and the connected bucket back and forth across the truck and insure that the operating edge of the bottom portion 57 will rake and spread the material deposited from side to side of the receptacle to spread it to a more uniform depth. Obviously this will be done at a time when the material has risen in the receptacle of the truck to a point above which the load of material should not rise. The benefits are believed obvious.

When the bucket is disposed at ground level and immediately forward of the vehicle 10, as enabled by the arrangement described, the movement of the vehicle 10 per se in the direction of the material to which the bucket is applied will serve together with the bucket in breaking up the mass of the material which might be otherwise very difficult to handle. The construction insures that this can be achieved without damage to the left arm assembly or the means by which it is slip fit to and connected with the vehicle.

FIGS. 6–9 show less preferred embodiments of the invention. They do, however, include features of the embodiment above described.

FIGS. 6 and 7 reveal lift arms 72 and 73 showing only the outer end of their inner arm portions 70 and 71, their outer end portions 74 and 75 and their joint plates 76 and 77 which respectively join the portions 70 and 74 and 71 and 75 of the respective lift arms. These arms are constructed and arranged and mounted for pivotal movement on a base frame and by hydraulic units such as demonstrated in FIGS. 1–5, to which reference is made for their detail. Of such support and controls for the pivoting thereof, there are here illustrated only the outer end portions of the piston-type operating rods 78 and 79, corresponding to rods 25, associated with the hydraulic cylinder units through which they are pivoted on the base frame.

In this case, however, the outer portions of the lift arms are interconnected adjacent and spaced forwardly of their transversely aligned joint plates 75 and 76 by a cross beam 80, the respective ends of which abut and are welded to the facing inner sides of the arm portions 74 and 75.

A pair of U-shaped brackets 81 centered in laterally spaced relation on the top and between the ends of the beam 80 have their open ends projected upwardly of and perpendicular to the beam. Nested in the open end of each bracket 81, between and in alignment with laterally aligned apertures in its upwardly projecting plate-like arms is a sleeve welded to the base of a hydraulic cylinder unit 82 accommodating the insertion therethrough, and through the arms of the bracket to either end, of a pivot pin 83. The pivot pins 83 serve to pivotally connect the base ends of the hydraulic cylinder units 82 so that these units extends from the beam 80 in a parallel forwardly projected relation, with the projected operating ends of their piston rods outermost. Each of the projected extremities have a sleeve welded cross wise of the rods, similar to that disposed in a bracket 81, which slips into the open end of a U-shaped bracket 84 the base of which is fixed to the rear wall surface of a material handling device shown as a bucket 85. The brackets 84 are in a laterally spaced centered relation to the lateral extent of the rear wall surface of the bucket and adjacent its bottom edge. Spaced outwardly of the brackets 84 on the rear wall 86 of the bucket and at a higher level than the brackets 84 are two pairs of bracket plates 87, the bracket plates of each pair of which have two pairs of transversely aligned apertures, which pairs are vertically spaced. The respective pairs of bracket plates 87 are respectively adjacent and parallel to the lateral sides of the bucket surface 86 and each thereof is arranged to nest therebetween, intermediate their vertically spaced pairs of transversely aligned apertures, the forward end of a generally channel-shaped beam 88 constructed similarly to the members 34, 35 first described. Each beam 88 has an apertured bracket fixed to depend from its underside at its forward end which nests between a pair of the bracket plates 87 to have thrust through the aperture in its bracket a pivot pin 89 passed through the lower pair of transversely aligned apertures in the bracket plates between which it nests. The beams 88 are thereby pivotally connected to the bucket 85.

The upper pair of transversely aligned apertures in each pair of bracket plates 87 has thrust therethrough and through a sleeve 90 therebetween which aligns therewith a pivot pin 91. The sleeve 90 is welded to and crosswise of the outer projected end of the piston type operating rod of a hydraulic cylinder unit 92. The base end of the housing of each unit 92 has welded thereto and cross wise thereof a sleeve 93. The sleeve 93 in each case nests in the open upper end of and is pivotally connected to a U-shaped bracket 94 the base of which is fixed on the upper rear end surface portion of the beam 88 the forward end of which is pivotally connected to the lower portion of the same pair of bracket plates 87 to the upper end of which is pivotally connected the piston rod of the hydraulic cylinder unit which the beam mounts.

The channel-shaped beams 88 are open to their rearmost ends and provide tracks therein for rollers in the manner of the members 34 and 35 in the embodiment of FIGS. 1–5. In this case, however, the open sides of the beams face each other and are laterally spaced by their connection to the bucket 85 so as to enable their respective disposition adjacent and immediately outward of the respective outer sides of the lift arm portions 74 and 75, in embracing relation thereto. Note that in the first described embodiment the outer lift arm portions closely embrace the carriage assembly.

By analogy the beams 88 form side frame members for a sliding carriage which they form with the interconnected bucket 85. In this embodiment each of the outer sides of the lift arm portions 74 and 75 mount a line of closely spaced rollers 95, the lines of which are in the direction of the lift arm portions to which they mount.

As will be obvious, the carriage assembly in this case will slip on the lift arms in easy fashion as the beams 88 are positioned to have their respective open ends align with and respectively receive therein the rollers 95 to the respective outer sides of the lift arms. The easy slip fit and removal of the carriage assembly is self evident. On mount of the carriage assembly to the arms this is the time that the piston rods of the hydraulic cylinder units 82 are pivotally connected to the brackets 84 on the bucket.

The arrangement is such that as in the first embodiment described suitable conventional controls and connections are provided for appropriately directing hydraulic fluid to and from opposite ends of each of the housings of the hydraulic cylinder units described whereby to project and retract the piston rods which form a part thereof. As will be seen, when the assembly of the carriage to the lift arms is effected and it is fully seated by way of the beams 88 accomodating rollers 95 and the cylinder units 82 and 92 are retracted, the cylinder units 92 are not only parallel but they are each substantially equally spaced from and parallel to the upper surface of the beam 88 to which they mount. The cylinder units 82 are also parallel but inclined forwardly and downwardly to their connections to the bucket 85 adjacent its bottom edge. Under such conditions the lift arms may be manipulated to bring the bucket to ground level as discussed in the first instance and used to break material away from a stack thereof and lifted as required, for example, over a receptacle on the bed of a truck, positioning the lift arm portions 75 and 74 horizontally. Then, by suitable actuation of the cylinder units 92 to project their piston rods, one may pivot the bucket 85 to a dumping attitude. The position of the piston rods in this case produces a composite of forces which not only provide relative tilting of the bucket but, since in the process the projected extremities of the piston rods of cylinders 82 are lifted, there is an inherent movement of the beams outwardly of the lift arms, stably supported by rollers 95. Thus, the tilting operation produces an increased outreach of the bucket. Upon projection of the operative piston rods of the hydraulic cylinder units 82, the carriage assembly may be moved further to provide increased outreach of the lift arms. Of course, the piston rods of units 82 may be reciprocated for leveling the material adjacent the top of the receptacle in which it is deposited as first described.

The embodiment of FIGS. 8 and 9 is identical to that shown in FIGS. 6 and 7 except that in this case the hydraulic cylinder units 82 are replaced by inextensible rigid rods of equal length. In use of this embodiment, as will be obvious, the carriage assembly functions only as if the rods 82' were units 82 the piston rods of which are always retracted. Thus, this modification does have capability to extend outreach of the bucket 85 in the tilting thereof but no further outreach is possible.

Note the connection of the channel-shaped beams to the bucket in each embodiment described positions them in a horizontal medial plane of the connected bucket when the bucket is not tilted. The hydraulic cylinder units or inextensible rods 82, 82' or the cylinder unit 46 connects at the same time by way of their or its operating rod to the central portion of the rear wall of the material handling device utilized, adjacent its lower edge, as the hydraulic cylinder units used to reciprocate the carriage assembly involved are operative at a level adjacent the upper edge of the material handling device. This arrangement facilitates a positive and smooth inducement of the carriage assembly to extend the outreach of the bucket in connection therewith.

In the instance of the embodiments of FIGS. 6–9 as in that of FIGS. 1–5, the carriage assembly is strongly supported and stabilized to inhibit distortion. At the same time the embracing relation of the carriage assembly in respect to the outer end portions of the lift arms preclude uneven application of forces with obvious benefits to the related parts and their operation.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A lift arm assembly comprising a pair of lift arms each pivotally connecting at one end to a base support to project outwardly therefrom, each of said arms being constructed and arranged to comprise an inner arm portion and an outer arm portion one of which forms a direct extension of the other, tie means rigidly connecting said outer arm portions said tie means maintaining said outer arm portions in a spaced parallel relation, a carriage supported in a generally bridging relation to and on means defining bearing surfaces interconnected with said outer arm portions, said carriage having a pivotally connected material handling device forming therewith a carriage assembly, means based on said tie means and projected forwardly therefrom to couple to a portion of said assembly, said means based upon said tie means including a portion thereof operative on said assembly to induce a movement of said assembly on said bearing surfaces from an installed position located inwardly of the length of said outer arm portions to a position advanced therefrom in a direction outwardly with reference to the ends of said outer arm portions which are remote from said inner arm portions to effectively increase the outreach of said arms from their base support and reversely operative to induce a reverse movement of said carriage assembly when required, said carriage assembly being constructed and arranged to extend said outer arm portions by substantially the effective length thereof and having guide means in association therewith to stabilize said assembly and preclude misalignment or distorting motions thereof throughout its advancing and reverse movements on and outwardly of said outer arm portions to substantially the extent of its effective length.

2. A lift arm assembly as in claim 1 wherein said carriage and said outer end portions of said lift arms are coupled in an installed position of said carriage assembly so at least a portion of one thereof is in an embracing relation to at least a portion of the other and said carriage having means mounted thereto for adjusting said material handling device during and at any point in movement of said carriage assembly, independent of the advance and reverse movements of said carriage assembly.

3. A lift arm assembly as in claim 2 wherein said outer arm portions of said lift arms are in laterally embracing relation to at least a portion of said carriage which is disposed therebetween.

4. A lift arm assembly as in claim 1 wherein said carriage includes a pair of parallel arm portions which project rearwardly of said material handling device to embrace and bear on roller means mounted to the outer ends of said outer arm portions of said lift arms.

5. A lift arm assembly as in claim 1 wherein the outer end portions of said lift arms and said tie means mounted to a portion thereof means defining sleeve-like recesses accommodating rods embodied in connection with said carriage assembly and the projected extremities of said outer arm portions mount roller means which track in portions of said carriage assembly to provide a stabilizing interconnection therebetween.

6. A lift arm assembly as in claim 1 including in combination with said lift arms a base support means having vertically projected portions adapted to position upwardly from the vehicle to which said base support is applied at the upper extremity of which are pivotally connected the said one ends of said lift arms to dispose said arms to provide that in a lowered position thereof said material handling device may be located at ground surface immediately forward of the front end of the vehicle to which said base support is applied, in a position for advantageous application therethrough of forces to dislodge difficult to handle materials positioned on the ground surface for displacement to another location or a receptacle.

7. An assembly as in claim 6 characterized in that said lift arms are arranged so that said inner arm portions and said outer arm portions thereof form an obtuse angle therebetween.

8. A lift arm assembly as in claim 1 wherein said arms are positioned by a base support in connection therewith so said one ends of each arms pivotally connected to said base support are located in elevated relation to the body of a vehicle mounting said base support and said arms in each case have their inner arm portions and their outer arm portions form an obtuse angle therebetween, the angle of which provides said arms with an ability to dispose their outer arm portions in a horizontal position when said arms are lifted, thereby to facilitate a horizontal reciprocation of said material handling device.

9. A lift arm assembly as in claim 1 characterized in that said means based on said tie means is connected to said carriage assembly to induce a straight line movement thereof in each of the opposite directions.

10. A lift arm assembly as in claim 1 including means for inducing an extending movement of said carriage assembly in an automatic response to a tilting of said material handling device.

11. A lift arm assembly as in claim 1 wherein said carriage to which said material handling device pivotally connects includes a pair of laterally spaced arms to one end of which is pivotally connected said material handling device in bridging relation thereto and said carriage arms have one side of each forming a track arranged to bear on roller means mounted in projected relation to said outer arm portions adjacent their outermost extremities to facilitate the assembly of said carriage assembly to said lift arms, the coupling of said carriage assembly to said arms being positively provided through the medium of said coupling means based upon said tie means.

12. A lift arm assembly as in claim 11 wherein each of said arms to which said material handling device is pivotally connected mounts thereon an actuator having a reciprocable portion pivotally connected to said material handling device for tilting thereof as and when required.

13. A lift arm assembly as in claim 1 wherein said means based upon said tie means comprises a fluid power cylinder adapted for a straight line reciprocation of said carriage assembly.

14. A lift arm assembly as in claim 1 wherein each of said outer arm portions mounts a single roller adjacent its projected extremity on which said carriage assembly bears to provide for movements of said carriage in a straight line path, said rollers being disposed and located to serve as bearing surfaces facilitating assembly and disassembly of said carriage from said lift arms.

15. A lift arm assembly as in claim 1 mounted to a base support wherein said base support includes a generally U-shaped frame to provide for a slip fit mount of said arm assembly to a vehicle from one end thereof.

16. A lift arm assembly comprising a pair of lift arms each pivotally connecting at one end to a base support to project outwardly therefrom, said arms being constructed and arranged to comprise inner arm portions including said one end thereof and outer arm portions at their projected extremities, said outer arm portions being arranged in spaced parallel relation by rigidly interconnected tie means which extend between the adjacent sides of said arms at a location adjacent the innermost limits of the length of their outermost arm portions, a carriage including a pivotally connected material handling device forming therewith a carriage assembly which mounts in generally bridging relation to said outermost arm portions, means based on said tie means and projected forwardly therefrom to couple to a portion of said assembly, said means based on said tie means including a portion thereof operative on said assembly to induce its movement from its normally installed position to a position advanced therefrom in a direction outwardly with reference to said outer arm portions to effectively increase the outreach of said arms from their base support and further operative to induce a reverse movement of said assembly when required and guide means interrelating said carriage assembly with said lift arms independent of the said coupling means to produce a secondary lateral control of said carriage assembly in the movements thereof.

17. A lift arm assembly comprising a pair of lift arms each pivotally connecting at one end to a base support to project outwardly therefrom, said arms being constructed and arranged to comprise inner arm portions including said one end thereof and outer arm portions at their projected extremities, said outer arm portions being arranged in spaced parallel relation by rigidly interconnected tie means which extend between said arms at a location adjacent the innermost limits of the length of their outermost arm portions, a carriage including a pivotally connected material handling device forming therewith a carriage assembly which mounts in a generally bridging relation to said outermost arm portions, means based on said tie means and projected forwardly therefrom to couple to a portion of said assembly, said means based on said tie means including a portion thereof operative on said carriage assembly to induce its movement from an installed position to a position advanced therefrom in a direction outwardly with reference to said outer arm portions to effectively increase the outreach of said arms from their base support and further operative to induce a reverse movement of said carriage assembly when required, said means based on said tie means being connected to said carriage assembly to induce a straight line movement thereof in each of opposite directions and means for tilting said material handling device based on the portion of said carriage to which said material handling device pivotally connects.

18. A lift arm assembly comprising a pair of lift arms each pivotally connecting at one end to a base support to project outwardly therefrom, said arms being constructed and arranged to comprise inner arm portions including said one end thereof and outer arm portions at their projected extremities, said outer arm portions being arranged in spaced parallel relation by rigidly interconnected tie means which extend between said arms at a location adjacent the innermost limits of the length of their outermost arm portions, a carriage including a pivotally connected material handling device forming therewith a carriage assembly which mounts in generally bridging relation to said outermost arm portions, means based on said tie means and projected forwardly therefrom to couple to a portion of said assembly, said means based on said tie means including a portion thereof operative on said assembly to induce its movement from its normally installed position to a position advanced therefrom in a direction outwardly with reference to said outer arm portions to effectively increase the outreach of said arms from their base support and further operative to induce a reverse movement of said assembly when required, said means based upon said tie means having a direct connection to said material handling device and being constructed and arranged to project and induce a movement of said material handling device and the carriage assembly of which it forms a part to move outwardly of said outer arm portions.

19. An assembly as in claim 16 characterized in that said means based upon said tie device is constructed and arranged to also induce tilting movements of said material handling device.

20. A lift arm assembly comprising a pair of lift arms each pivotally connecting at one end to a base support to project outwardly therefrom, said arms being constructed and arrranged to comprise inner arm portions including said one end thereof and outer arm portions at their projected extremities, said outer arm portions being arranged in spaced parallel relation by rigidly interconnected tie means which extend between said arms at a location adjacent the innermost limits of the length of their outermost arm portions, a carriage including a pivotally connected material handling device forming therewith a carriage assembly which mounts in generally bridging relation to said outermost arm portions, means based on said tie means and projected forwardly therefrom to couple to a portion of said assembly, said means based upon said tie device being an integral member of defined length which pivotally connects to said material handling device, and portions of said carriage to which said material handling device pivotally connects mounting means to induce an outward movement of said carriage assembly on said lift arms concurrently with a tilting of said material handling device in conjunction with said means based upon said tie member.

* * * * *

UNITED STATES PATENT AND TRADEMARK OFFICE

CERTIFICATE OF CORRECTION

PATENT NO. : 4,306,832

DATED : December 22, 1981

INVENTOR(S) : Gregory Schmiesing

It is certified that error appears in the above—identified patent and that said Letters Patent is hereby corrected as shown below:

ABSTRACT, line 13, -- in -- is inserted following "and/or";

line 14, "from" is corrected to read -- form --.

Col. 3, line 63, "predetermined" is corrected to read -- preferred --.

Col. 6, line 9, "carrige" is corrected to read -- carriage --.

Col. 8, line 11, "left" is corrected to read -- lift --;

line 31, "plates" is corrected to read -- plate --.

Col. 9, line 12, "left" is corrected to read -- lift --;

line 18, "end" is corrected to read -- ends --.

Col. 12, line 59 (Claim 5, line 2) "mounted" is corrected to read -- mount --

Col. 13, line 18 (Claim 8, line 3) "each" is corrected to read -- said --.

line 31 (Claim 9, line 4) delete "the" following -- of --.

Signed and Sealed this

*Twenty-fifth* Day of *May 1982*

[SEAL]

*Attest:*

GERALD J. MOSSINGHOFF

*Attesting Officer*

*Commissioner of Patents and Trademarks*